US011006787B2

(12) United States Patent
Abuharthieh

(10) Patent No.: US 11,006,787 B2
(45) Date of Patent: May 18, 2021

(54) TOILET PAPER ROLLER ASSEMBLY

(71) Applicant: Kamel Abuharthieh, Lodi, NJ (US)

(72) Inventor: Kamel Abuharthieh, Lodi, NJ (US)

( * ) Notice: Subject to any disclaimer, the term of this patent is extended or adjusted under 35 U.S.C. 154(b) by 164 days.

(21) Appl. No.: 16/441,333

(22) Filed: Jun. 14, 2019

(65) Prior Publication Data

US 2020/0390294 A1 Dec. 17, 2020

(51) Int. Cl.
*A47K 10/22* (2006.01)
*A47K 10/38* (2006.01)
*A47K 10/32* (2006.01)

(52) U.S. Cl.
CPC ..... *A47K 10/22* (2013.01); *A47K 10/38* (2013.01); *A47K 2010/3246* (2013.01)

(58) Field of Classification Search
CPC ..... A47K 10/22; A47K 10/38; A47K 2010/3675; A47K 2010/3863; A47K 2010/3246; B65H 23/06; B65H 2403/72
USPC ..... 242/423, 423.1, 423.2
See application file for complete search history.

(56) References Cited

U.S. PATENT DOCUMENTS 3,770,221 A 11/1973 Stern
3,850,379 A 11/1974 Stern
4,239,163 A 12/1980 Christian
D266,213 S 9/1982 Heil
4,447,015 A 5/1984 Peterson
4,610,123 A * 9/1986 Krone ..... A01F 15/0715 188/187
4,828,193 A 5/1989 Galbraith
5,249,755 A 10/1993 Jespersen
5,564,645 A * 10/1996 Lissoni ..... B65H 23/06 242/423.1
5,755,397 A * 5/1998 Freese ..... A47K 10/38 242/423.1
5,794,882 A * 8/1998 Lewis ..... A47K 10/38 242/423.1
5,938,142 A * 8/1999 Halperin ..... A47K 10/38 242/423.1
2004/0104295 A1* 6/2004 Fujioka ..... B65H 23/06 242/422.4

FOREIGN PATENT DOCUMENTS

FR 2401862 A1 * 3/1979 ..... B65H 23/06

* cited by examiner

*Primary Examiner* — William A. Rivera

(57) ABSTRACT

A toilet paper roller assembly includes a roller that is inserted through a roll of toilet paper. The roller has a plurality of teeth each disposed within the roller. A cap is removably coupled to the roller rollably engage a respective one of a pair of toilet paper rollers on a support surface. A shaft is inserted into the roller to engage a respective one of a pair of toilet paper rollers on the support surface. The shaft has a plurality of teeth disposed thereon. The roller is positionable in a rolling position having the teeth on the roller disengaged from the teeth on the shaft for rolling the roll of toilet paper. The roller is positionable in a locked position has the teeth on the roller engaging the teeth on the shaft to inhibit the roll of toilet paper from rotating.

8 Claims, 3 Drawing Sheets

TOILET PAPER ROLLER ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to roller devices and more particularly pertains to a new roller device for positioning a roll of toilet paper being a rolling position and a locked position.

BRIEF SUMMARY OF THE INVENTION

An embodiment of the disclosure meets the needs presented above by generally comprising a roller that is inserted through a roll of toilet paper. The roller has a plurality of teeth each disposed within the roller. A cap is removably coupled to the roller rollably engage a respective one of a pair of toilet paper rollers on a support surface. A shaft is inserted into the roller to engage a respective one of a pair of toilet paper rollers on the support surface. The shaft has a plurality of teeth disposed thereon. The roller is positionable in a rolling position having the teeth on the roller disengaged from the teeth on the shaft for rolling the roll of toilet paper. The roller is positionable in a locked position has the teeth on the roller engaging the teeth on the shaft to inhibit the roll of toilet paper from rotating.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
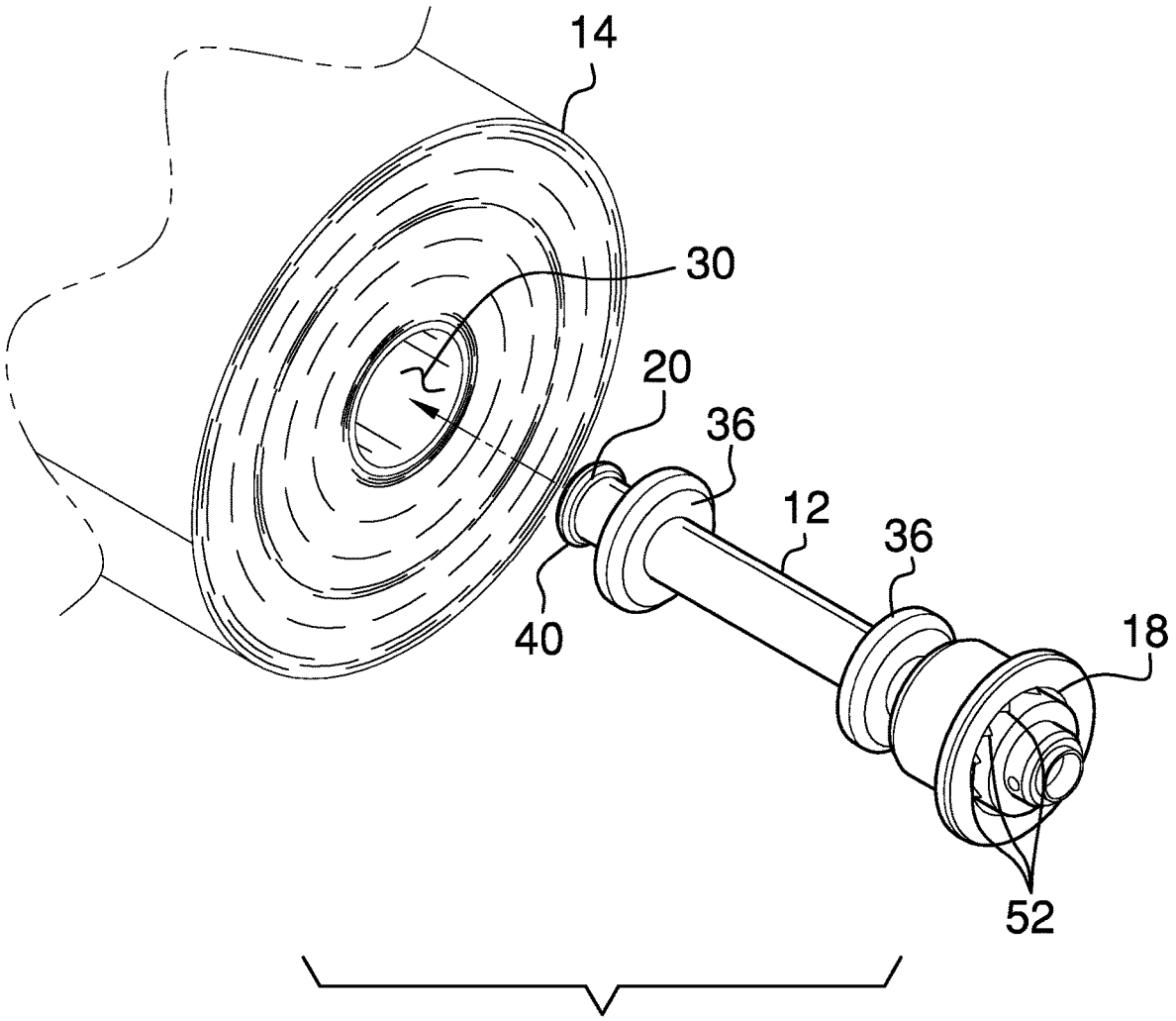
FIG. 1 is an exploded in-use view of a toilet paper roller assembly according to an embodiment of the disclosure.
Figure 2:
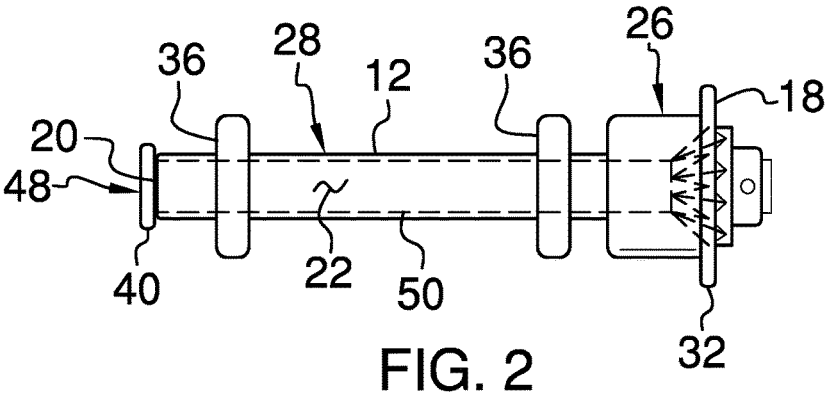
FIG. 2 is a front phantom view of an embodiment of the disclosure.
Figure 3:
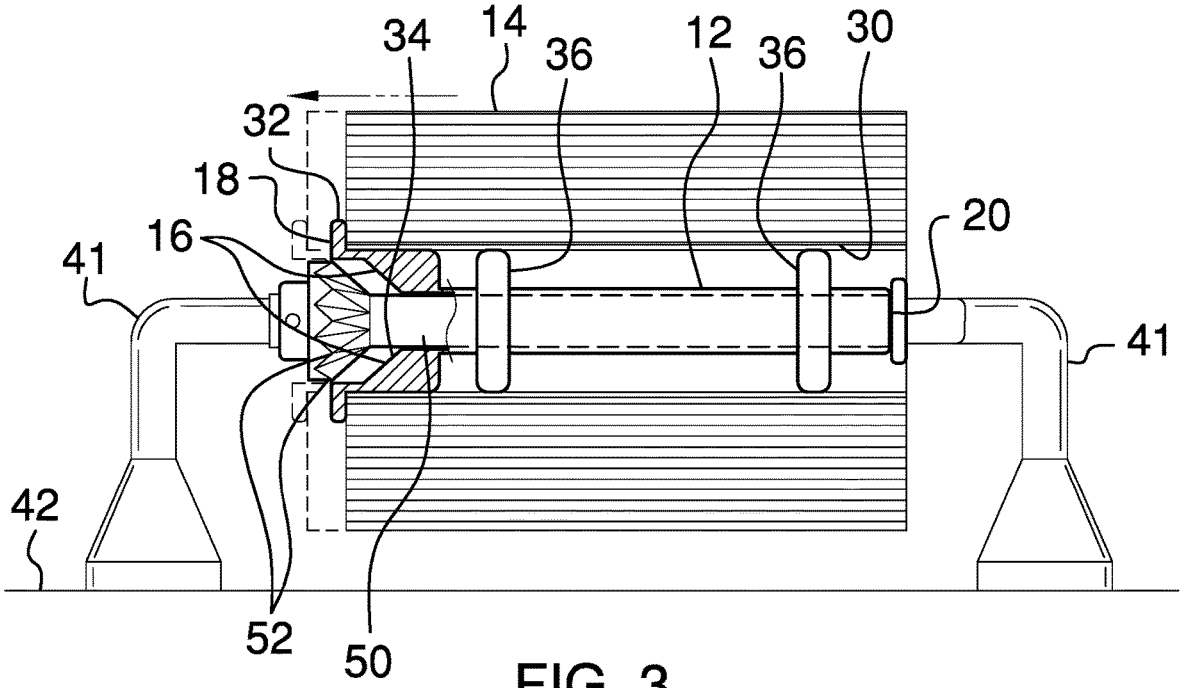
FIG. 3 is a cut away in-use view of an embodiment of the disclosure.
Figure 4:
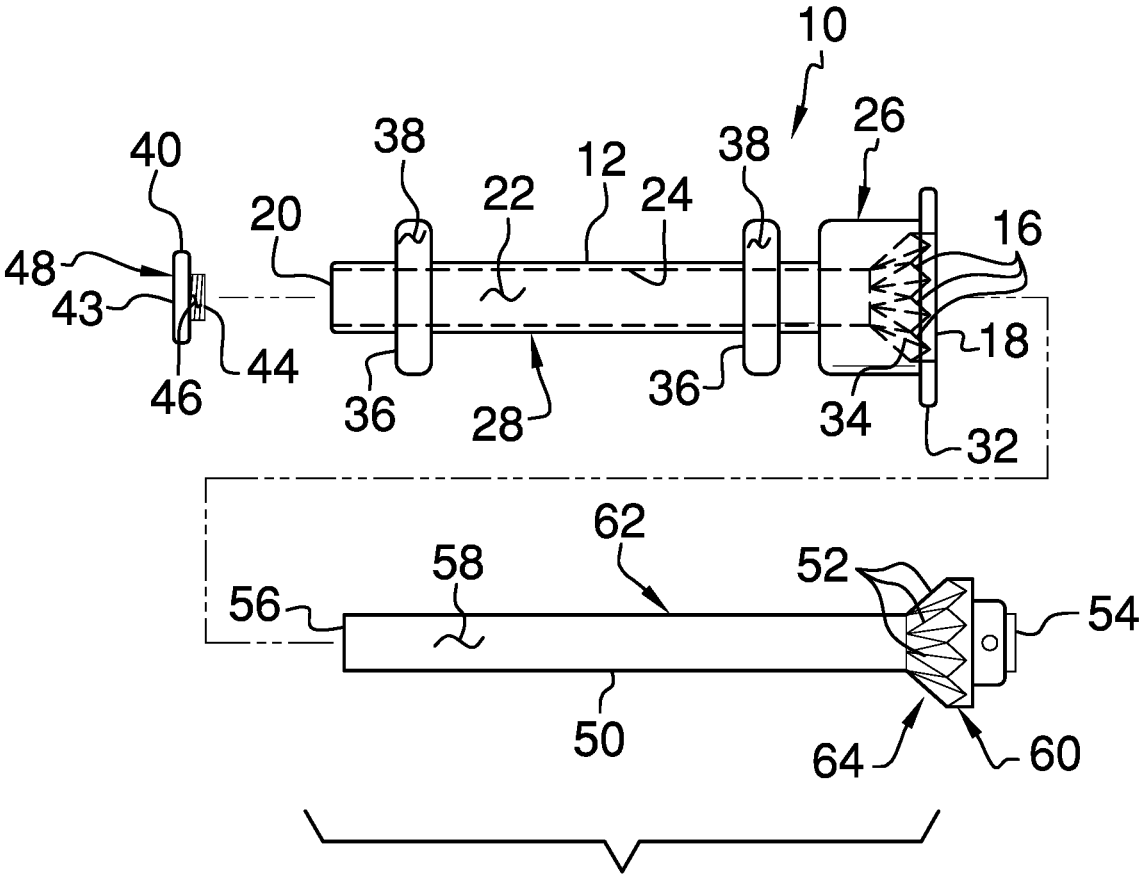
FIG. 4 is an exploded perspective view of an embodiment of the disclosure.

With reference now to the drawings, and in particular to FIGS. 1 through 4 thereof, a new roller device embodying the principles and concepts of an embodiment of the disclosure and generally designated by the reference numeral 10 will be described.

As best illustrated in FIGS. 1 through 4, the toilet paper roller assembly 10 generally comprises a roller 12 that is inserted through a roll of toilet paper 14. The roller 12 has a plurality of teeth 16 each being disposed within the roller 12. The roller 12 is hollow and the roller 12 has a first end 18, a second end 20, an outer surface 22 and an inner surface 24. The roller 12 is elongated between the first 18 and second 20 ends, and each of the first 18 and second 20 ends is open. Each of the inner 24 and outer 22 surfaces is continuously arcuate about an axis extending through the first 18 and second 20 ends such that the roller 12 has a tubular shape.

The outer surface 22 has a first portion 26 has a diameter that is greater than a diameter of a second portion 28, and the first portion 26 extends from the first end 18 toward the second end 20. The outer surface 22 of the first portion 26 abuts an inside surface 30 of the roll of toilet paper 14 when the roller 12 is inserted into the roll of toilet paper 14. The outer surface 22 of the first portion 26 has a lip 32 extending outwardly therefrom. The lip 32 is aligned with the first end 18 to abut the roll of toilet paper 14 when the roller 12 is inserted into the roll of toilet paper 14. In this way the roll of toilet paper 14 is inhibited from passing beyond the lip 32.

The inner surface 24 of the first portion 26 has an angled section 34 angling inwardly from the first end 18 toward the inside surface 30 of the second portion 28. The angled section 34 has each of the teeth 16 being positioned thereon. The teeth 16 are spaced apart from each other and are distributed around an entire circumference of the angled section 34. A pair of wheels 36 is provided and each of the wheels 36 has the roller 12 extending therethrough. Thus, each of the wheels 36 abuts the inside surface 30 of the roll of toilet paper 14. Each of the wheels 36 extends around the outside surface 46 of the roller 12. The wheels 36 are spaced apart from each other and are distributed along the second section of the outer surface 22 of the roller 12. Each of the wheels 36 has a distal surface 38 with respect to the outer surface 22 of the roller 12 that abuts the inside surface 30 of the roll of toilet paper 14.

A cap 40 is removably coupled to the roller 12 and the cap 40 rollably engages a respective one of a pair of toilet paper rollers 41 on a support surface 42. The support surface 42 may be a wall in a bathroom. The cap 40 has a first end 43, a second end 44 and an outside surface 46 extending therebetween. The outside surface 46 is threaded and the first end 43 of the cap 40 has a well 48 extending toward the second end 44 of the cap 40. The well 48 insertably receives the respective toilet paper rollers 41. Additionally, the second end 20 of the roller 12 insertably receives the second end 44 of the cap 40 having the outside surface 46 threadably engaging the inside surface 24 of the roller 12.

A shaft 50 is provided and the shaft 50 is inserted into the roller 12. The shaft 50 engages a respective one of the pair of toilet paper rollers 41 on the support surface 42 for retaining the roll of toilet paper 14 between the pair of toilet paper rollers 41. The shaft 50 has a plurality of teeth 52 that are disposed thereon. The roller 12 is positionable in a rolling position having the teeth 16 on the roller 12 being disengaged from the teeth 52 on the shaft 50. In this way the roller 12 can rotate about the shaft 50. Thus, the roll of toilet paper 14 can be rotated to draw toilet paper off of the roll of toilet paper 14.

The roller 12 is positionable in a locked position having the teeth 16 on the roller 12 engaging the teeth 52 on the shaft 50 thereby inhibiting the roller 12 from rotating about the shaft 50. In this way the roll of toilet paper 14 is inhibited from being rotated to rip the toilet paper off of the roll of toilet paper 14. The shaft 50 has a primary end 54, a secondary end 56 and an exterior surface 58 extending therebetween. The exterior surface 58 has a primary section 60 which has a diameter that is greater than a diameter of a secondary section 62 of the exterior surface 58. The primary section 60 extends from the primary end 54 toward the secondary end 56.

The roller 12 insertably receives the secondary section 62. The primary section 60 has an angled portion 64 angling inwardly between the exterior surface 58 of the primary section 60 and the exterior surface 58 of the secondary section 62. Each of the teeth 52 on the shaft 50 is positioned on the angled portion 64. The primary section 60 is spaced outwardly from the first portion 26 of the roller 12 when the roller 12 is positioned in the rolling position. Conversely, the primary section 60 is inserted into the first portion 26 when the roller 12 is positioned in the locked position. In this way the teeth 16 on the roller 12 engages the teeth 52 on the shaft 50.

In use, the shaft 50 is inserted into the roller 12 and the roller 12 is inserted into the roll of toilet paper 14. The cap 40 rollably engages the respective toilet paper rollers 41 and the primary end 54 of the shaft 50 fixedly engages the respective toilet paper roller 42. In this way the roll of toilet paper 14 is retained between the toilet paper rollers 41. The roll of toilet paper 14 is slid laterally away from the primary end 54 of the shaft 50 thereby spacing the teeth 16 on the roller 12 from the teeth 52 on the shaft 50. In this way the roll of toilet paper 14 can roll for pulling a selected length of toilet paper off of the roll of toilet paper 14. The roll of toilet paper 14 is slid laterally toward the primary end 54 of the shaft 50 thereby facilitating the teeth 16 on the roller 12 to engage the teeth 52 on the shaft 50. In this way the roll of toilet paper 14 is inhibited from rolling to rip the selected length of toilet paper from the roll of toilet paper 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet paper roller assembly being configured to selectively lock a roll of toilet paper thereby inhibiting the roll of toilet paper from being rotated, said assembly comprising:

a roller being configured to be inserted through a roll of toilet paper, said roller having a plurality of teeth each being disposed within said roller, said roller being hollow;

a pair of wheels, each of said wheels having said roller extending therethrough wherein each of said wheels is configured to abut the inside surface of the roll of toilet paper;

a cap being removably coupled to said roller wherein said cap is configured to rollably engage a respective one of a pair of toilet paper rollers on a support surface; and a shaft being inserted into said roller wherein said shaft is configured to engage a respective one of a pair of toilet paper rollers on the support surface for retaining the roll of toilet paper between the pair of toilet paper rollers, said shaft having a plurality of teeth being disposed thereon, said roller being positionable in a rolling position having said teeth on said roller being disengaged from said teeth on said shaft thereby facilitating said roller to rotate about said shaft wherein the roll of toilet paper is configured to be rotated to draw toilet paper off of the roll of toilet paper, said roller being positionable in a locked position having said teeth on said roller engaging said teeth on said shaft thereby inhibiting said roller from rotating about said shaft wherein the roll of toilet paper is configured to be inhibited from rotated to rip the toilet paper off of the roll of toilet paper.

2. The assembly according to claim 1, wherein:

said roller has a first end, a second end, an outer surface and an inner surface, said roller being elongated between said first and second ends, each of said first and second ends being open, each of said inner and outer surfaces being continuously arcuate about an axis extending through said first and second ends such that said roller has a tubular shape;

said outer surface having a first portion having a diameter being greater than a diameter of a second portion, said first portion extending from said first end toward said second end, said outer surface of said first portion being configured to abut an inside surface of the roll of toilet paper when said roller is inserted into the roll of toilet paper; and said outer surface of said first portion has a lip extending outwardly therefrom, said lip being aligned with said first end wherein said lip is configured to abut the roll of toilet paper when said roller is inserted into the roll of toilet paper to inhibit the roll of toilet paper from passing beyond said lip.

3. The assembly according to claim 2, wherein said inner surface of said first portion has an angled section angling inwardly from said first end toward said inside surface of said second portion, said angled section having each of said teeth being positioned thereon, said teeth being spaced apart from each other and being distributed around an entire circumference of said angled section.

4. The assembly according to claim 3, wherein said shaft has a primary end, a secondary end and an exterior surface extending therebetween, said exterior surface having a primary section having a diameter being greater than a diameter of a secondary section of said exterior surface, said roller insertably receiving said secondary section.

5. The assembly according to claim 4, wherein said primary section has an angled portion angling inwardly between said exterior surface of said primary section and said exterior surface of said secondary section, each of said teeth on said shaft being positioned on said angled portion, said primary section being spaced outwardly from said first portion of said roller when said roller is positioned in said rolling position, said primary section being inserted into said first portion when said roller is positioned in said locked position.

6. The assembly according to claim 2, wherein each of said wheels extends around said outside surface of said roller, said wheels being spaced apart from each other and being distributed along said second section of said outer surface of said roller, each of said wheels having a distal surface with respect to said outer surface of said roller wherein said distal surface of each of said wheels is configured to abut the inside surface of the roll of toilet paper.

7. The assembly according to claim 2, wherein said cap has a first end, a second end and an outside surface extending therebetween, said outside surface being threaded, said first end having a well extending toward said second end wherein said well is configured to insertably receive the respective toilet paper roller, said second end of said roller insertably receiving said second end of said cap having said outside surface threadably engaging said inside surface of said roller.

8. A toilet paper roller assembly being configured to selectively lock a roll of toilet paper thereby inhibiting the roll of toilet paper from being rotated, said assembly comprising:

a roller being configured to be inserted through a roll of toilet paper, said roller having a plurality of teeth each being disposed within said roller, said roller being hollow, said roller having a first end, a second end, an outer surface and an inner surface, said roller being elongated between said first and second ends, each of said first and second ends being open, each of said inner and outer surfaces being continuously arcuate about an axis extending through said first and second ends such that said roller has a tubular shape, said outer surface having a first portion having a diameter being greater than a diameter of a second portion, said first portion extending from said first end toward said second end, said outer surface of said first portion being configured to abut an inside surface of the roll of toilet paper when said roller is inserted into the roll of toilet paper, said outer surface of said first portion having a lip extending outwardly therefrom, said lip being aligned with said first end wherein said lip is configured to abut the roll of toilet paper when said roller is inserted into the roll of toilet paper to inhibit the roll of toilet paper from passing beyond said lip, said inner surface of said first portion having an angled section angling inwardly from said first end toward said inside surface of said second portion, said angled section having each of said teeth being positioned thereon, said teeth being spaced apart from each other and being distributed around an entire circumference of said angled section;

a pair of wheels, each of said wheels having said roller extending therethrough wherein each of said wheels is configured to abut the inside surface of the roll of toilet paper, each of said wheels extending around said outside surface of said roller, said wheels being spaced apart from each other and being distributed along said second section of said outer surface of said roller, each of said wheels having a distal surface with respect to said outer surface of said roller wherein said distal surface of each of said wheels is configured to abut the inside surface of the roll of toilet paper;

a cap being removably coupled to said roller wherein said cap is configured to rollably engage a respective one of a pair of toilet paper rollers on a support surface, said cap having a first end, a second end and an outside surface extending therebetween, said outside surface being threaded, said first end having a well extending toward said second end wherein said well is configured to insertably receive the respective toilet paper roller, said second end of said roller insertably receiving said second end of said cap having said outside surface threadably engaging said inside surface of said roller; and a shaft being inserted into said roller wherein said shaft is configured to engage a respective one of a pair of toilet paper rollers on the support surface for retaining the roll of toilet paper between the pair of toilet paper rollers, said shaft having a plurality of teeth being disposed thereon, said roller being positionable in a rolling position having said teeth on said roller being disengaged from said teeth on said shaft thereby facilitating said roller to rotate about said shaft wherein the roll of toilet paper is configured to be rotated to draw toilet paper off of the roll of toilet paper, said roller being positionable in a locked position having said teeth on said roller engaging said teeth on said shaft thereby inhibiting said roller from rotating about said shaft wherein the roll of toilet paper is configured to be inhibited from rotated to rip the toilet paper off of the roll of toilet paper, said shaft having a primary end, a secondary end and an exterior surface extending therebetween, said exterior surface having a primary section having a diameter being greater than a diameter of a secondary section of said exterior surface, said roller insertably receiving said secondary section, said primary section having an angled portion angling inwardly between said exterior surface of said primary section and said exterior surface of said secondary section, each of said teeth on said shaft being positioned on said angled portion, said primary section being spaced outwardly from said first portion of said roller when said roller is positioned in said rolling position, said primary section being inserted into said first portion when said roller is positioned in said locked position.

* * * * *